United States Patent [19]

Mayr

[11] 4,427,319

[45] Jan. 24, 1984

[54] LIFTING EQUIPMENT FOR AN OFFSHORE CONSTRUCTION

[75] Inventor: Heribert Mayr, Oberhausen, Fed. Rep. of Germany

[73] Assignee: Deutsche Babcock Anlagen Aktiengesellschaft, Oberhausen, Fed. Rep. of Germany

[21] Appl. No.: 331,969

[22] Filed: Dec. 18, 1981

[30] Foreign Application Priority Data

Mar. 31, 1981 [DE] Fed. Rep. of Germany ..... 3112702

[51] Int. Cl.[3] ..... E02B 17/08

[52] U.S. Cl. ..... 405/196; 405/208

[58] Field of Search ..... 405/196–199, 405/207, 208; 254/105, 107; 114/264, 265

[56] References Cited

U.S. PATENT DOCUMENTS

| | | | |
|---|---|---|---|
| 202,415 | 4/1878 | Cumming | 405/196 |
| 1,531,371 | 3/1925 | Belknap | 405/196 |
| 2,892,314 | 6/1959 | Hornsby et al. | 405/196 |
| 2,972,973 | 2/1961 | Thearle | 114/264 |
| 4,041,711 | 8/1977 | Lucas | 405/197 |
| 4,329,088 | 5/1982 | Lucas | 254/105 |

FOREIGN PATENT DOCUMENTS

| | | | |
|---|---|---|---|
| 2430580 | 1/1975 | Fed. Rep. of Germany | 405/199 |

*Primary Examiner*—Dennis L. Taylor
*Assistant Examiner*—John A. Gungor
*Attorney, Agent, or Firm*—Max Fogiel

[57] ABSTRACT

An offshore construction in which a floatable platform is supported through raisable and lowerable support legs directly or indirectly on the sea bed. At least two cable winches for each support leg are arranged as lifting equipment on the platform. One cable winch is connected through a single cable line with the lower end of a support leg. The other cable winch displays a multiple cable line guided around two pulley blocks. One of these pulley blocks is arranged on the support leg. In order to be able to employ the lifting equipment even in the case of great support leg lengths, the other pulley block is arranged on a ring. This ring surrounds the support leg and is detachably connected through a locking device with the platform.

6 Claims, 7 Drawing Figures

„X"
A
B
1
2
3
4
5
6,7
8
9
10
11
12
13

LIFTING EQUIPMENT FOR AN OFFSHORE CONSTRUCTION

BACKGROUND OF THE INVENTION

The present invention concerns a lifting equipment for an offshore construction of a floatable platform with raisable and lowerable support legs bearing directly or indirectly on the sea bed. At least two cable winches for each support leg are arranged on the platform. One cable winch is connected through a single cable line with the lower end of a support leg and the other cable winch displays a multiple cable line guided around two pulley blocks, one of which is arranged on the support leg.

Such a lifting equipment is related subject matter of the German Patent Application No. 3 008 585. By this lifting equipment, it is possible during the erection of the offshore construction to put the support legs down free of shock or substantially free of shock even when the sea is not quiet. For this, the lifting equipment is constructed in such a manner that it is blocked against a downwardly directed movement caused by the motion of the sea each time, when with the support legs touching down and the platform floating, this is disposed just at the highest point of the wave motion. In that case, the drive of the one cable winch is switched off, while the other cable winch is freed in spooling direction and the unspooling direction is blocked. In order to be able to lift the weight of the platform, which can amount to 20,000 to 40,000 tons, a cable winch with a multiple cable line must be used. At small depths of water or on the use of a sub-structure, which has been previously lowered onto the sea bed and onto which the support legs touch down, the lift to be exerted by the cable winch and thereby the cable length even with a multiple cable line is comparatively small. For great lengths of the support legs of 100 meters, for example, the required cable lengths are no longer to be managed in the case of a multiply-guided cable line.

SUMMARY OF THE INVENTION

The present invention is based on the task of further developing a lifting equipment of the initially named kind which can be used also for offshore constructions with great support leg lengths.

This problem is solved according to the present invention by arranging a second pulley block on a ring which surrounds the support leg and is detachably connected through a locking device with the platform. In that case, the ring, which is preferably slidingly guided on the support leg, can in the unlocked state be suspended at such a spacing from the other end of the support leg, that it meets a counterbearing in the platform during the downward movement of the support legs when the support legs are disposed just above the touch-down point on the sea bed.

Through the use of the ring, a relatively small rope length can be managed within this lifting equipment. During the downward movement of the support legs with the platform floating, the spacing from the upper end of the support leg with respect to the ring does not change up to the impingement of the ring onto the platform. In this phase, the cable winch with the multiple cable line need only take up the single cable length which corresponds to the relative spacing between the pulley block on the upper end of the respective support leg and the location of the cable winch on the platform.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DESCRIPTION OF THE PREFERRED EMBODIMENTS

The illustrated offshore construction consists of a floatably constructed platform 1 with a rectangular or square cross-section. The platform 1 is provided with four raisable and lowerable support legs 2, which are movable relatively to it and connected together at their lower ends through a common base frame 3. The platform 1 is towed to above the place of erection at sea, with support legs 2 drawn up. After reaching the envisaged position, the support legs 2 are lowered with the aid of the lifting equipment described in the following until they sit on the sea bed 4.

Figures 1, 2, 3:
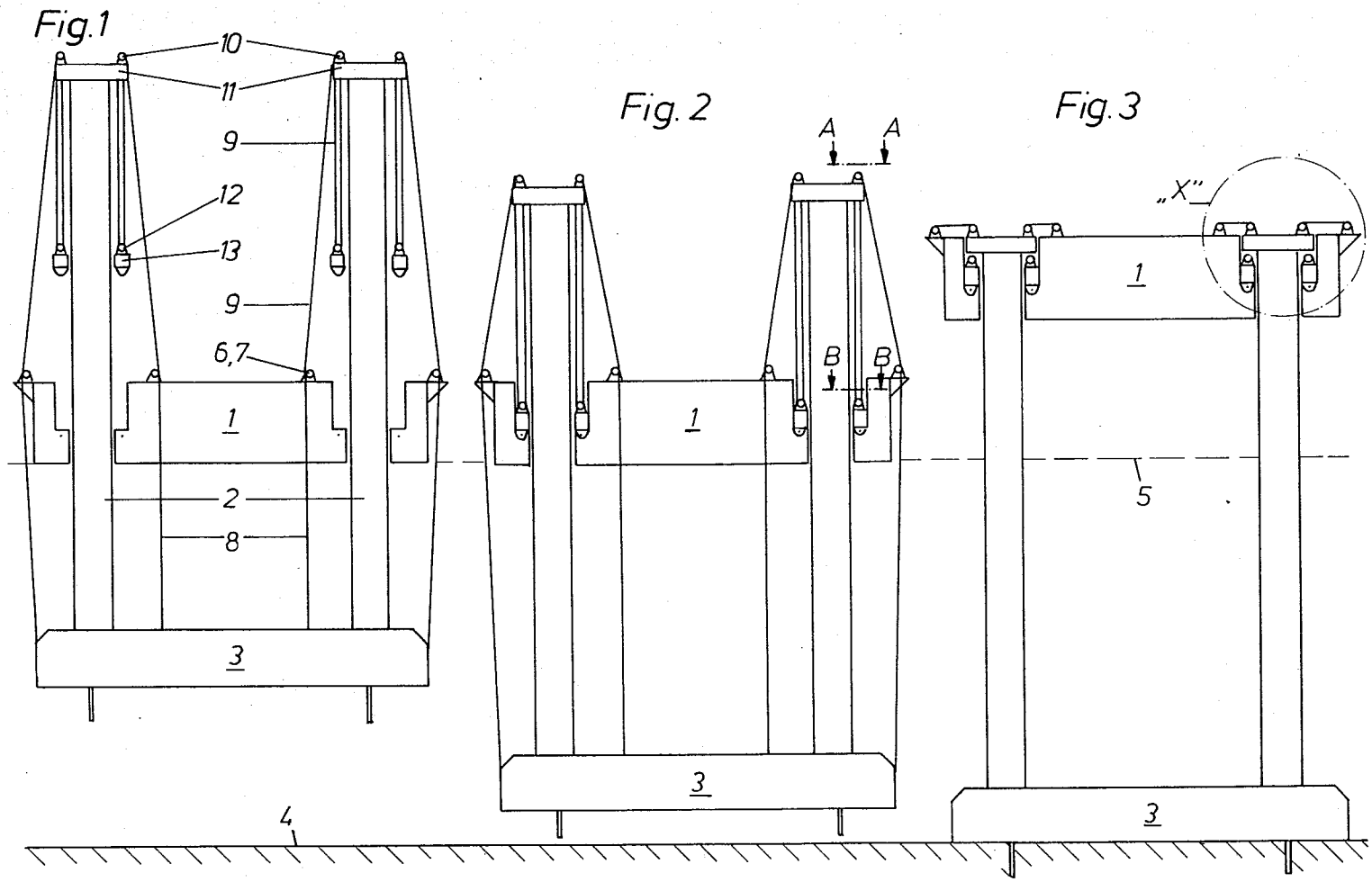
FIGS. 1 to 3 show the offshore construction in different phases of the erection with the aid of a lifting equipment, according to the present invention.
Figure 4:
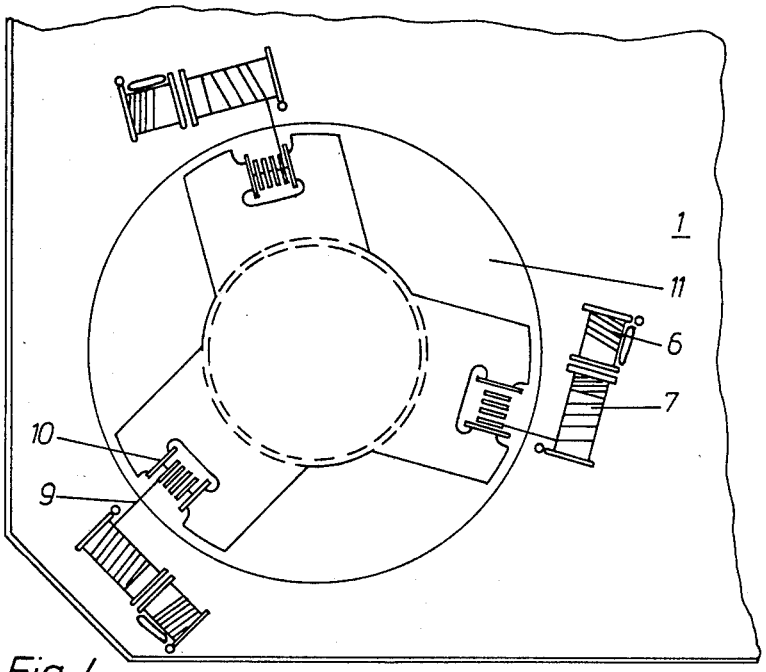
FIG. 4 is a plan view in direction A according to FIG. 2.
Figure 5:
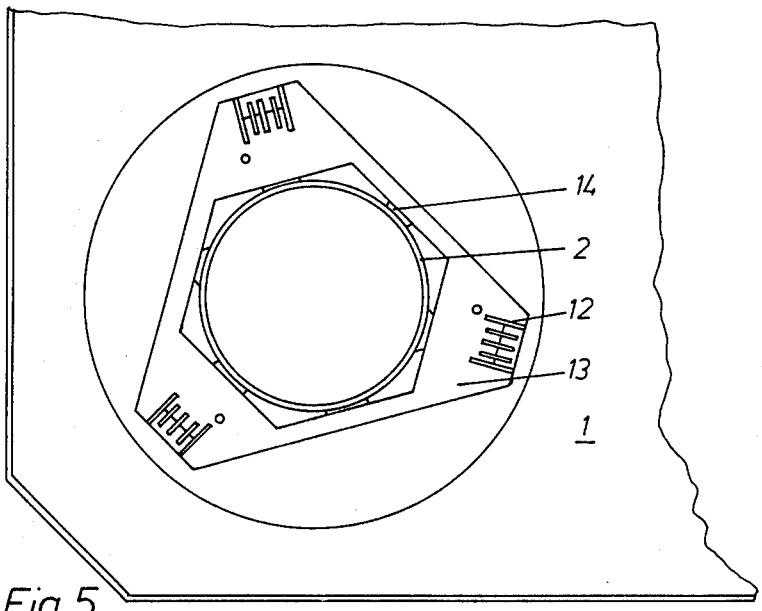
FIG. 5 is a plan view in direction B according to FIG. 2.
Figure 6:
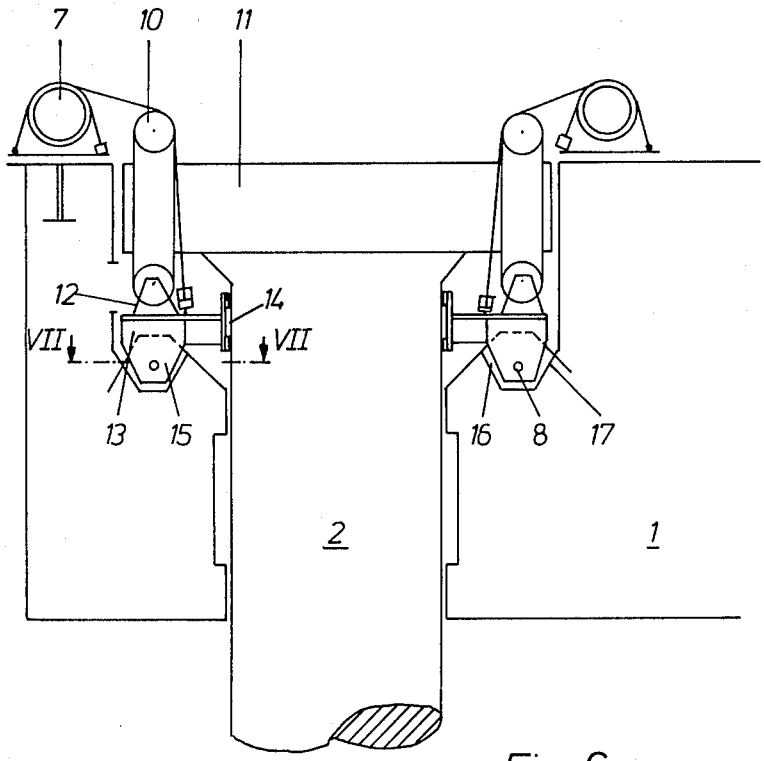
FIG. 6 shows the detail X according to FIG. 3.
Figure 7:
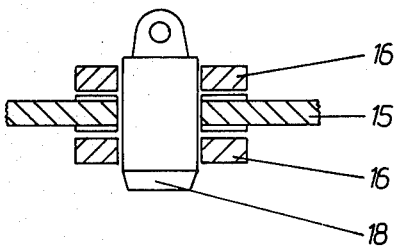
FIG. 7 is a section VII—VII according to FIG. 6.

This phase is illustrated in the FIG. 1. Subsequently, the platform 1 is raised up to the desired height above the sea surface 5. In the operational state of the offshore construction, according to FIG. 3, the support legs 2 of the platform 1 are supported through the base frame 3 on the sea bed 4.

Two cable winches 6 and 7, which are drivable independently of one another, serve as lifting equipment. Both the cable winches 6 and 7 are arranged on the platform 1. Each of the four support legs is provided with at least one—in the illustrated case, three such lifting equipments.

The first cable winch 6 serves for the lowering and raising of the support leg 2 and operates on a single cable line. The cable 8 is guided to one fastening point at the lower end of the support leg 2 or at the base frame 3. The second cable winch 7 serves for the raising and lowering of the platform 1 and operates on a multiple cable line. The lifting cable 9 for load introduction onto the support leg 2 is guided over an upper pulley block 10, which is arranged on a yoke 11 at the upper end of the support leg 2.

The lower pulley block 12 for the lifting cable 9 of the second cable winch 7 is disposed together with the fixed point of the cable on a ring 13. This ring 13 surrounds the support leg 2. The ring 13 is guided slidingly through sliding bearings 14 on the support leg 2. The ring 13 on its underside displays guide strips 15, which engage between corresponding strips 16 of a counterbearing 17 mounted on the platform 1. The guide strips 15 of the ring 13 and the strips 16 of the counterbearing 17 are provided with a bore, through which an axially displaceable locking pin 18 engages, when these bores are aligned. Through this locking device, the ring 13 can be connected with the platform 1.

During the phase of the lowering of the support legs 2 onto the sea bed 4 with the platform 1 floating, the ring 13 hangs freely at a certain spacing below the yoke 11 (FIG. 1). In this phase, the cable 8 is let out from the first cable winch 6, while the second cable winch 7 spools up the lifting cable 9 in only single length. Before the support legs 2 have nearly reached their touch-down point and are, for example, disposed only still 6 meters above the sea bed 4, then the ring 13 just engages by its guide strips 15 into the gap between the strips 16 of the counterbearing 17.

The multiply-guided cable line of the lifting cable 7 is therefore to be adjusted to this length. This length corresponds substantially to the spacing considered to be necessary above the touch-down point of the support legs and the height of the platform in the end position above the sea surface 5. After the engagement of the ring 13, the locking pin 18 is pushed in, so that a firm connection is produced between the ring 13 and the platform 1. The further lowering of the support legs 2 and the subsequent raising of the platform 1 into the end position, illustrated in FIG. 3, above the sea surface 5 now takes place with the aid of the second cable winch 7 with constant shortening of the multiple cable line of the lifting cable 9. In the end position, the platform 1 is connected with the support legs 2 through a welded connection or through bolts. The ring 13 is then relieved and transmits no load. The cable winches 6 and 7 can be removed. The lifting equipment can be provided with an equipment according to the German Pat. No. 3 008 585, through which it is possible that the lifting equipment with the support legs 2 put down and platform 1 floating is blocked against a downwardly directed movement when the platform 1 is disposed just at the highest point of the wave motion. This additional equipment becomes effective when the ring 13 is connected with the platform 1.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Lifting equipment for an offshore construction of a floatable platform, comprising: raisable and lowerable support legs bearing on the sea bed; a floatable platform; at least two cable winches for each support leg arranged on the platform; one cable winch being connected through a single cable line with the lower end of a support leg, the other cable winch having a multiple cable line guided around two pulley blocks; one of said pulley blocks being arranged on the support leg; locking means; a ring surrounding said support leg and being detachably connected through said locking means with the platform; the other pulley block being arranged on said ring.

2. Lifting equipment according to claim 1, wherein said ring is slidingly guided on said support leg.

3. Lifting equipment according to claim 1 including a counter-bearing in said platform, said ring in the unlocked state being suspended at such a spacing from the upper end of said support leg that it meets said counter-bearing in said platform during downward movement of the support legs when the support legs are disposed just above the touch-down point on the sea bed.

4. Lifting equipment according to claim 1 including a counter-bearing in said platform, said ring in the unlocked state being suspended from the upper end of said support leg at a spacing corresponding to a predetermined distance above the touchdown point of said legs on the sea bed.

5. Lifting equipment as defined in claim 1, wherein said support legs are located directly on the sea bed.

6. Lifting equipment as defined in claim 1, wherein said support legs are located on a submerged structure resting on the sea bed.

* * * * *